US005605138A

United States Patent [19]

Deichsel et al.

[11] Patent Number: 5,605,138

[45] Date of Patent: Feb. 25, 1997

[54] METHOD AND APPARATUS FOR PROPORTIONING FUEL UPON THE STARTING OF AN INTERNAL COMBUSTION ENGINE

[75] Inventors: Hans Deichsel, Murr; Klaus Joos, Bietigheim-Bissingen; Ralf Klein, Bad Wimpfen; Bernhard Erb, Möglingen, all of Germany

[73] Assignee: Robert Bosch, GmbH, Stuttgart, Germany

[21] Appl. No.: 632,925

[22] Filed: Apr. 16, 1996

Related U.S. Application Data

[63] Continuation of Ser. No. 290,277, Aug. 15, 1994, abandoned.

[30] Foreign Application Priority Data

Sep. 1, 1993 [DE] Germany ..... 43 29 448.0

[51] Int. Cl.[6] ..... F02M 51/00

[52] U.S. Cl. ..... 123/491

[58] Field of Search ..... 123/491, 339, 123/179.3

[56] References Cited

U.S. PATENT DOCUMENTS

| | | | |
|---|---|---|---|
| 4,389,996 | 6/1983 | Yaegashi et al. | 123/491 |
| 4,418,674 | 12/1983 | Hasegawa et al. | 123/491 |
| 4,437,445 | 3/1984 | Takahashi et al. | 123/491 |
| 4,438,748 | 3/1984 | Ikeura et al. | 123/491 |
| 5,345,908 | 9/1994 | Nishimura et al. | 123/339 |
| 5,390,641 | 2/1995 | Yamada et al. | 123/491 |
| 5,408,975 | 4/1995 | Blakslee et al. | 123/491 |

FOREIGN PATENT DOCUMENTS

| | | | |
|---|---|---|---|
| 2410090A1 | 9/1975 | Germany | 123/491 |
| 4241821A1 | 6/1994 | Germany | 123/491 |

*Primary Examiner*—Raymond A. Nelli
*Attorney, Agent, or Firm*—Kenyon & Kenyon

[57] ABSTRACT

A method of proportioning fuel in an air/fuel mixture to be fed to an internal combustion engine upon starting, which method ensures reliable starting, even when fuel-injection settings which have been determined for good fuel, are used with poor fuel. As long as a test-end condition has not been satisfied, the engine's speed of rotation is checked to determine whether an increase in speed of rotation is present within a predetermined range. If not, a stored correction value for correcting the amount of fuel injected, which is determined as a function of the state of operation of the engine, is changed in such a manner so as to yield an air/fuel mixture which is ignitable in a desired manner, which mixture leads, upon combustion, to an increase in the speed of rotation within the predetermined range.

10 Claims, 4 Drawing Sheets

METHOD AND APPARATUS FOR PROPORTIONING FUEL UPON THE STARTING OF AN INTERNAL COMBUSTION ENGINE

This application is a continuation of application Ser. No. 08/290,277 for METHOD AND APPARATUS FOR PROPORTIONING FUEL UPON THE STARTING OF AN INTERNAL COMBUSTION ENGINE, filed on Aug. 15, 1994, now abandoned.

FIELD OF THE INVENTION

The present invention relates to a method and a device for proportioning fuel for the air/fuel mixture fed to an internal combustion engine upon starting.

BACKGROUND OF THE INVENTION

A method and a device for proportioning fuel upon the starting of an internal combustion engine are described in German Published Patent Application No. DT 24 10 090 A1. The aforementioned reference is concerned with a so-called hot start, i.e., wherein a hot engine has been shut off, has remained off for a few minutes, and is to be started again. While the hot engine is shut off, fuel evaporates in the fuel feed system with the result that, frequently, upon starting, fuel vapor instead of fuel is fed, resulting in an insufficient amount of injected fuel. In accordance with the aforementioned reference, when the starter of the engine has not been activated for longer than a predetermined period of time, the amount of fuel fed per injection is increased by a given percentage for a different predetermined period of time.

There may also be fuel-related starting problems, however, when the engine is cold, namely, when the fuel feed values applied for starting have been determined for a fuel other than the one that is now in the tank. The different fuels may be gasolines having rather different properties, but also gasoline on the one hand and ethanol on the other hand, or different gasoline/methanol mixtures.

Various methods are known for enabling operation of an internal combustion engine with different fuels. An example of a method for operating an internal combustion engine with different fuels is described in German Published Patent Application No. DE 42 41 821 A1 (which does not constitute prior art). The method described in that document, however, is not concerned with any special measures for the starting of the engine.

The problem thus exists of being able to start an internal combustion engine using poor fuel, where feed values for the fuel upon starting assume the use of a good fuel, and of being able to start the engine using good fuel, where feed values for the fuel upon starting assume use of a poor fuel.

SUMMARY OF THE INVENTION

An object of the present invention is to provide a method and a device for proportioning fuel in an air/fuel mixture to be fed to an internal combustion engine upon starting of the engine. The method and device of the present invention make it possible to reliably place the internal combustion engine in operation, even if the fuel has properties which do not correspond to the properties of the prior fuel, particularly the fuel values, which are used by the fuel injectors upon starting.

The method of the present invention checks whether, upon starting, an increase in the engine's speed of rotation lies within a predetermined range, for instance above a threshold value. If this condition is not satisfied, a stored correction value for correcting the amount of fuel injected, determined as a function of the operating state of the engine, is changed in such a manner so as to yield an air/fuel mixture which is ignitable in a desired manner, which then, upon combustion, leads to an increase in the speed of rotation which is within the predetermined range.

"Ignitable" in a desired manner is intended to mean that both mixtures which ignite better and mixtures which ignite poorer than the current mixture are involved. For instance, let it be assumed that after about 100 revolutions, a speed of rotation in the range between 1000 rpm and 1400 rpm is to be expected. If the speed of rotation is below this range, it is assumed that the air/fuel mixture is too lean, so that the correction value is increased. On the other hand, if the speed of rotation is above this range, it is assumed that the mixture is too rich and therefore ignites substantially better upon starting than the mixture which is actually desired. In the latter case, the correction value is reduced.

In the case just mentioned, in which the correction value is determined only after a relatively large number of revolutions and at a relatively high speed of rotation, the correction value determined is used only upon the next starting process. It is therefore assumed that the engine starts but that the starting conditions are not optimal. On the other hand, if whether the engine even starts at all is of concern, it is better to proceed in such a manner that, after only a very few revolutions, it is checked whether there is an increase in the speed of rotation within a predetermined range, or more simply, an increase above a threshold value, from one firing to the next or within a few firings. If this is not the case, the correction value is increased, still during the same starting process, in order to obtain an ignitable mixture.

The correction value is preferably stored in such a way that other fuel-quantity adjustment functions, such as, for instance, a restarting function or an acceleration enrichment function can access the correction value.

DETAILED DESCRIPTION OF THE DRAWINGS

Figure 1:
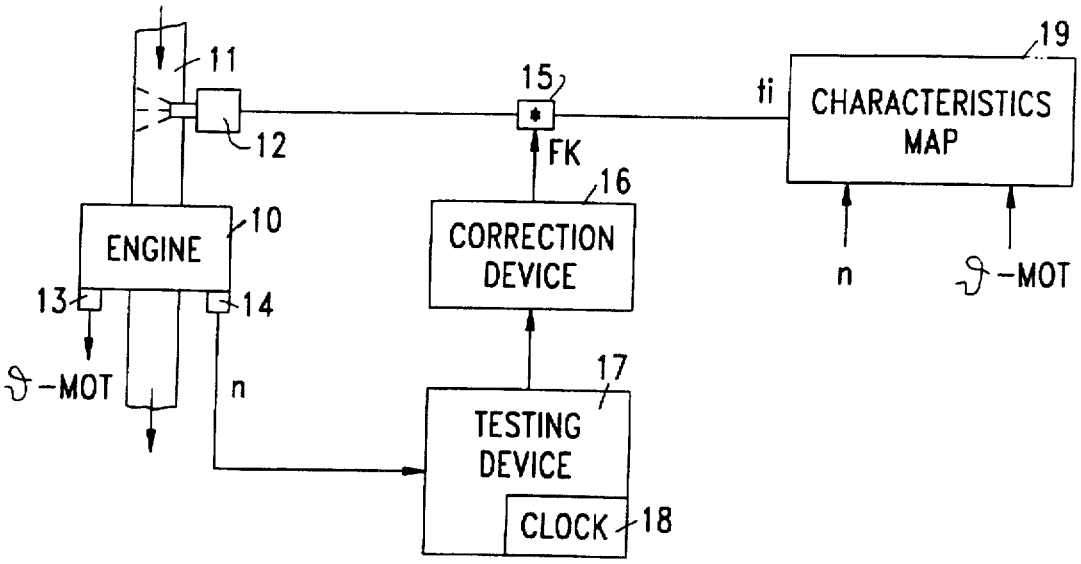
FIG. 1 is a block diagram of one embodiment of a device in accordance with the present invention.

FIG. 1 shows an internal combustion engine 10 having an intake pipe 11 into which an injection device 12 injects fuel. The corresponding injection times ti are read from a characteristics map 19 which is addressed in dependence upon certain values, in particular, the speed of rotation n, and the temperature v-MOT of the internal combustion engine 10. The temperature of the engine 10 is measured by an engine-temperature sensor 13, while the speed of rotation of the engine is measured by a speed-of-rotation sensor 14.

The injection time ti, read from the characteristics map 19, is multiplied in a multiplier 15 by a correction factor FK which is provided by a correction device 16 as a function of a signal from a testing device 17. The testing device 17, which includes a clock 18, receives a speed-of-rotation signal from the speed-of-rotation sensor 14.

The multiplier 15, testing device 17 and correction device 16 are part of a controller for proportioning fuel in the air/fuel mixture to be fed to the internal combustion engine 10 upon a starting of the engine. The testing device 17 tests whether there is an increase in the speed of rotation of the engine within a predetermined range, for as long as a test-end condition has not been satisfied. The correction device 16 changes the correction factor FK to correct an amount of fuel to be injected, as determined by the characteristics map 19, if it is determined by the testing device 17 that the increase in the engine speed of rotation is not within the predetermined range. The correction device 16 changes the correction factor FK as a function of a state of operation of the engine 10 so as to yield an air/fuel mixture which leads, upon combustion, to an increase in the sped of rotation within the predetermined range. The output of the multiplexer 15, which multiplies the injection time ti from the characteristics map 19 by the correction factor FK, is applied to the injection device 12 to accordingly control the quantity of fuel injected.

The above-mentioned characteristics map 19 is one which stores only injection times for starting. Other characteristics maps and other means of influencing injection times are not of interest in connection with the present invention.

Figure 2:
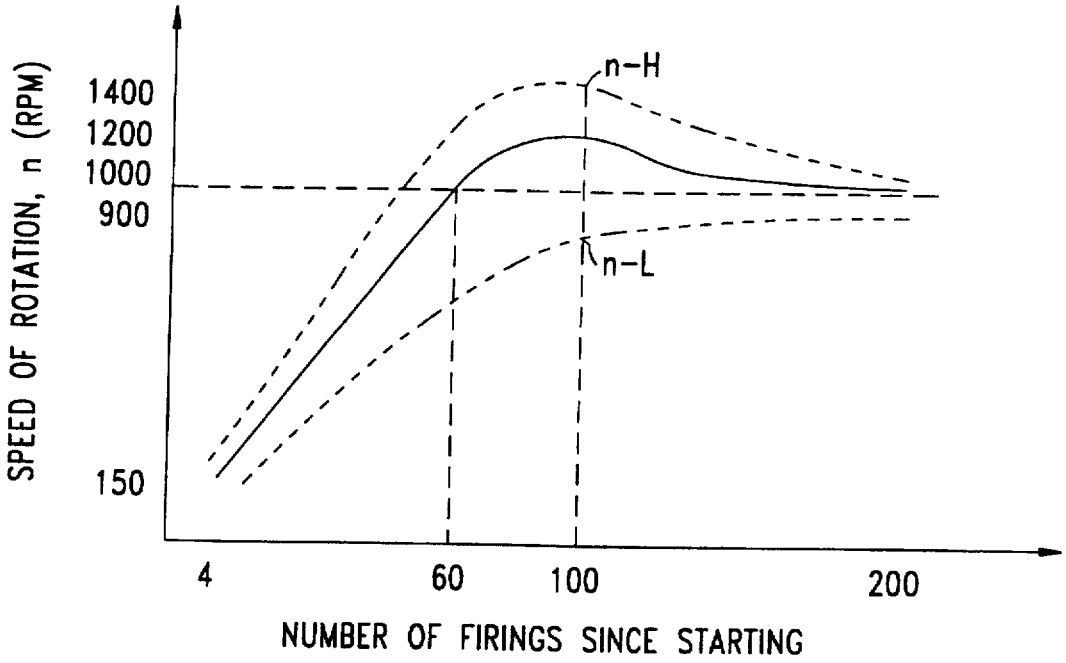
FIG. 2 is a graph showing the relationship between the speed of rotation (n) of an engine and the number of firings since the starting of the engine.

When the engine 10 is started. it is initially driven by a starter (not shown), which, after only a few revolutions (four revolutions in FIG. 2), drives the engine at the starter speed of rotation of, for instance, 150 rpm. In the case of low engine temperatures, the starter speed of rotation may also be substantially less, for instance only 80 rpm. When the air/fuel mixture fed to the engine is burning properly in the cylinders, there is a rapid increase in speed of rotation so that, after only about 60 firings, an idle speed of rotation of 1000 rpm is reached. As shown in FIG. 2, there is, however, an overshooting of the speed of rotation, so that after about 100 firings after the starting of the engine, a speed of rotation of about 1200 rpm is attained. Approximately 5 seconds, or 220 firings, after the starting of the engine, the engine rotates steadily at the idle speed of rotation. This average course of the speed of rotation is shown by a solid line in the graph of FIG. 2 as a function of the number of firings since the starting of the engine.

If the mixture burns relatively poorly, but still in such a manner that a satisfactory starting of the engine is obtained, the speed of rotation of the engine then follows a course in accordance with the bottom dashed curve in the graph of FIG. 2. If the mixture burns exceptionally well, but still in such a manner that the air/fuel mixture is not too rich with respect to the increased emission of noxious gas, the course shown by the upper dashed curve in the graph of FIG. 2 is obtained. Upon the maximum speed of rotation after about 100 firings from the start, there is thus obtained a range of speeds of rotation of between about 900 rpm and about 1200 rpm for the permissible range of speeds of rotation.

A first embodiment of a method with which the correction device 16 and the testing device 17 in the apparatus shown in FIG. 1 can operate, will now be described with reference to FIG. 3.

Upon the starting of the internal combustion engine 10, the stored correction factor FK is read out in step 3.1. Thereupon, at step 3.2, the amount of fuel, as determined by the injection time ti, is corrected by being multiplied by the correction factor. In step 3.3, the speed of rotation of the engine is measured in the testing device after a predetermined number of firings after the starting of the engine, for instance after 100 firings. Thereupon, at step 3.4, the speed of rotation is checked by the testing device to determine whether it is above an upper threshold value $N_{13}$ H of, for instance, 1200 rpm. If so, then the correction factor FK is reduced in step 3.5 by the correction device by, for instance, 10% and stored to be used the next time the engine is started. The procedure is then at an end.

If, however, it is determined at step 3.4 that the speed of rotation does not exceed the upper threshold, operation proceeds to step 3.6 in which it is determined whether the speed of rotation is below a lower threshold value $N_{13}$ L of, for instance, 900 rpm. If so, the correction factor is increased in step 3.7, for instance by 10%, and stored to be used the next time the engine is started. Thereafter, as well as in the event that the speed of rotation is not below the lower threshold value, the end of the process is reached.

Figure 3:
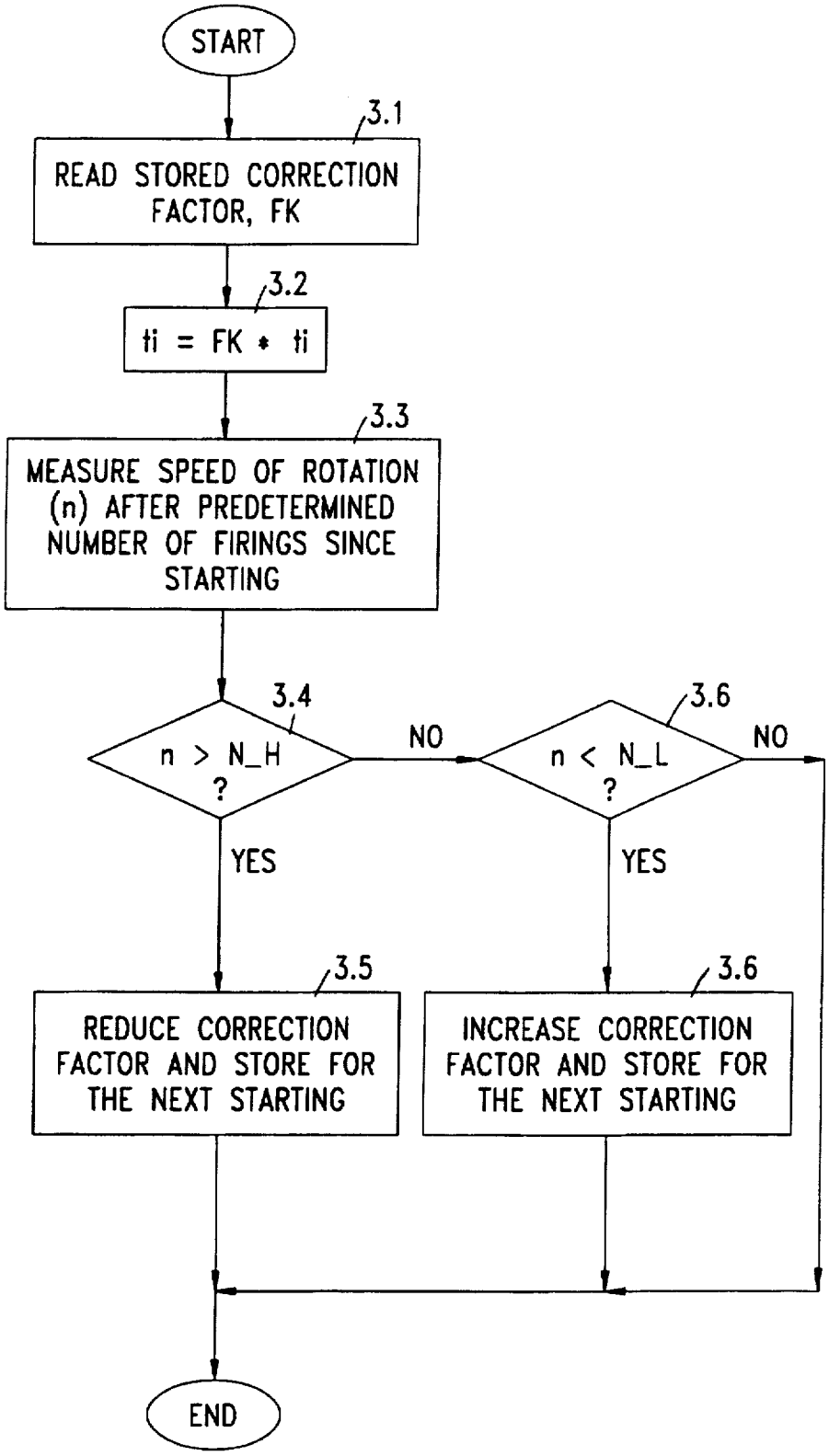
FIG. 3 is a flow chart of a method by which a correction value is determined and which is used in a starting process in accordance with the present invention.

In the procedure of FIG. 3, the determination of whether the speed of rotation lies within a predetermined range is carried out only for a single number of firings after the starting of the engine. Such a determination can also be carried out for several different speeds of rotation, as can be noted from FIG. 2. If this is done, the correction factor is changed when the speed of rotation, as detected for a given number of firings, does not lie within a predetermined range.

Since excessively rich mixtures do not present a problem for starting, the determination as to whether the speed of rotation exceeds an upper threshold speed of rotation can be omitted, thus simplifying the embodiment of FIG. 3.

On the basis of FIGS. 4 and 5, there will now be explained a method in which a correction factor can be continuously changed upon starting, if the starting process proceeds unsatisfactorily.

After the starting of the engine, it is checked in step 4.1 whether gasoline has been added to the vehicle in question. This is established, for instance, by a marked change in the reading of the fuel gauge. If gasoline has been added, the correction factor FK is set to an initial value, for instance the value "1", at step 4.2. Thereupon, as well as in the event that no gasoline has been added, step 4.3 is reached in which it is checked whether it is even worthwhile to perform an adaptation of the correction factor for the fuel used. Such an adaptation is not useful if other error conditions are present. Therefore, at step 4.3 it is checked whether the speed of rotation of the starter is above a predetermined threshold value, for instance 60 rpm, and whether the battery voltage is above a predetermined threshold value. If either of these conditions is not satisfied, it is assumed that a change in the amount of fuel can make no change in the poor starting behavior which is to be expected. Therefore, the end of the procedure of FIG. 4 is directly reached.

If, however, it is determined at step 4.3 that the starter speed of rotation and the battery voltage are above their respective threshold values, operation then pauses temporarily at step 4.4, awaiting the occurrence of several firings, e.g., five, after the starting of the engine. This is so that starting instabilities are overcome and since during the further procedure, the course of the speed of rotation over 5 firings is checked.

After the just-described steps, which are passed through only once after the starting of the engine, a loop comprising steps 4.5 to 4.7 is reached. In step 4.5, the injection time ti is corrected by the correction factor FK. Injection and firing are then effected. Thereafter, in step 4.6, a new correction factor is possibly determined. Step 4.6 will be explained further below with reference to the flow chart of FIG. 5. After step 4.6, at step 4.7 it is checked whether the end of the starting process has been reached. If not, then steps 4.5 to 4.7 are again looped through, until it is determined at step 4.7 that the procedure is at an end.

Figure 4:
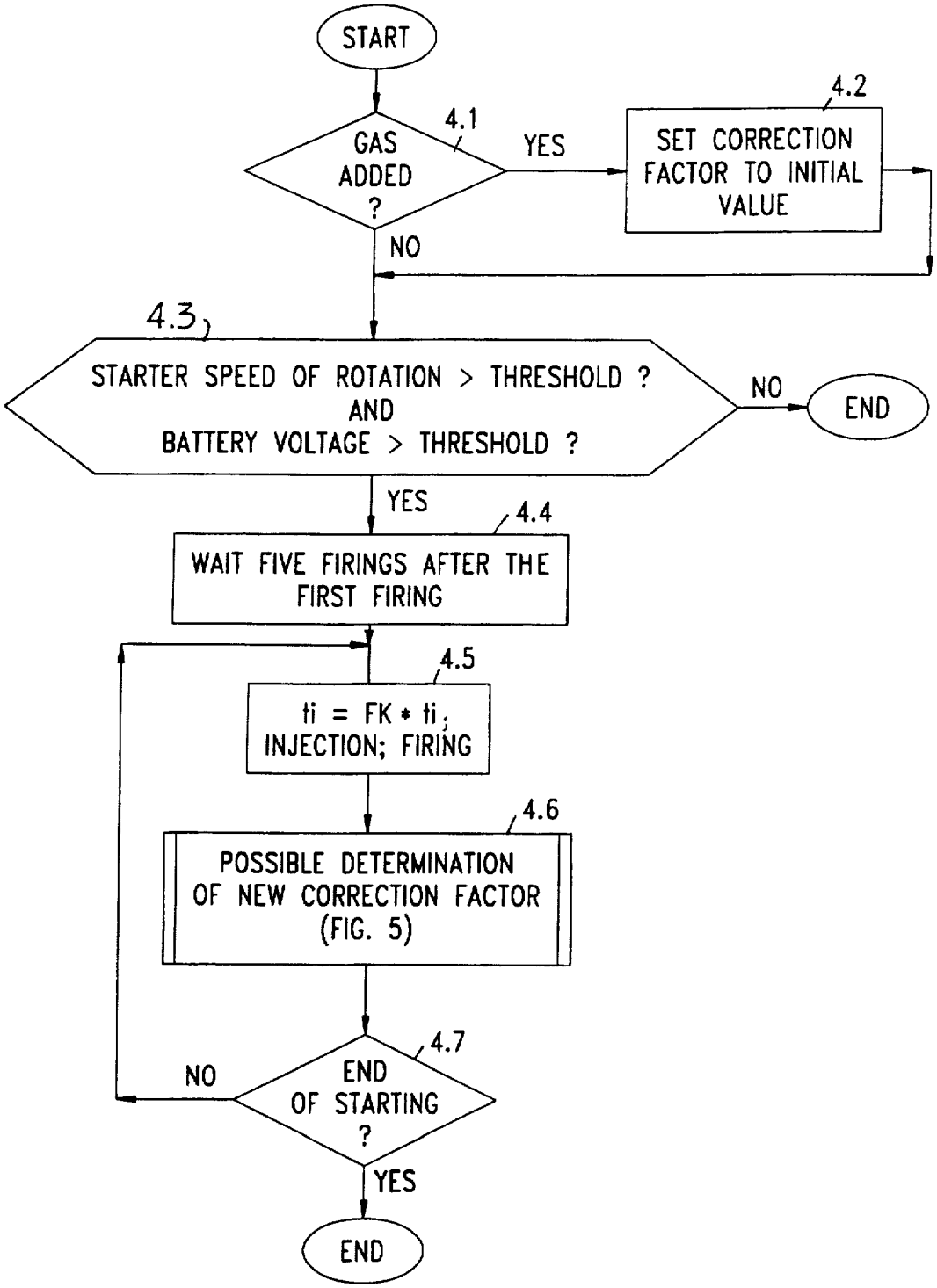
FIG. 4 is a flow chart of a method for determining a correction value as it is changed during a starting process.
Figure 5:
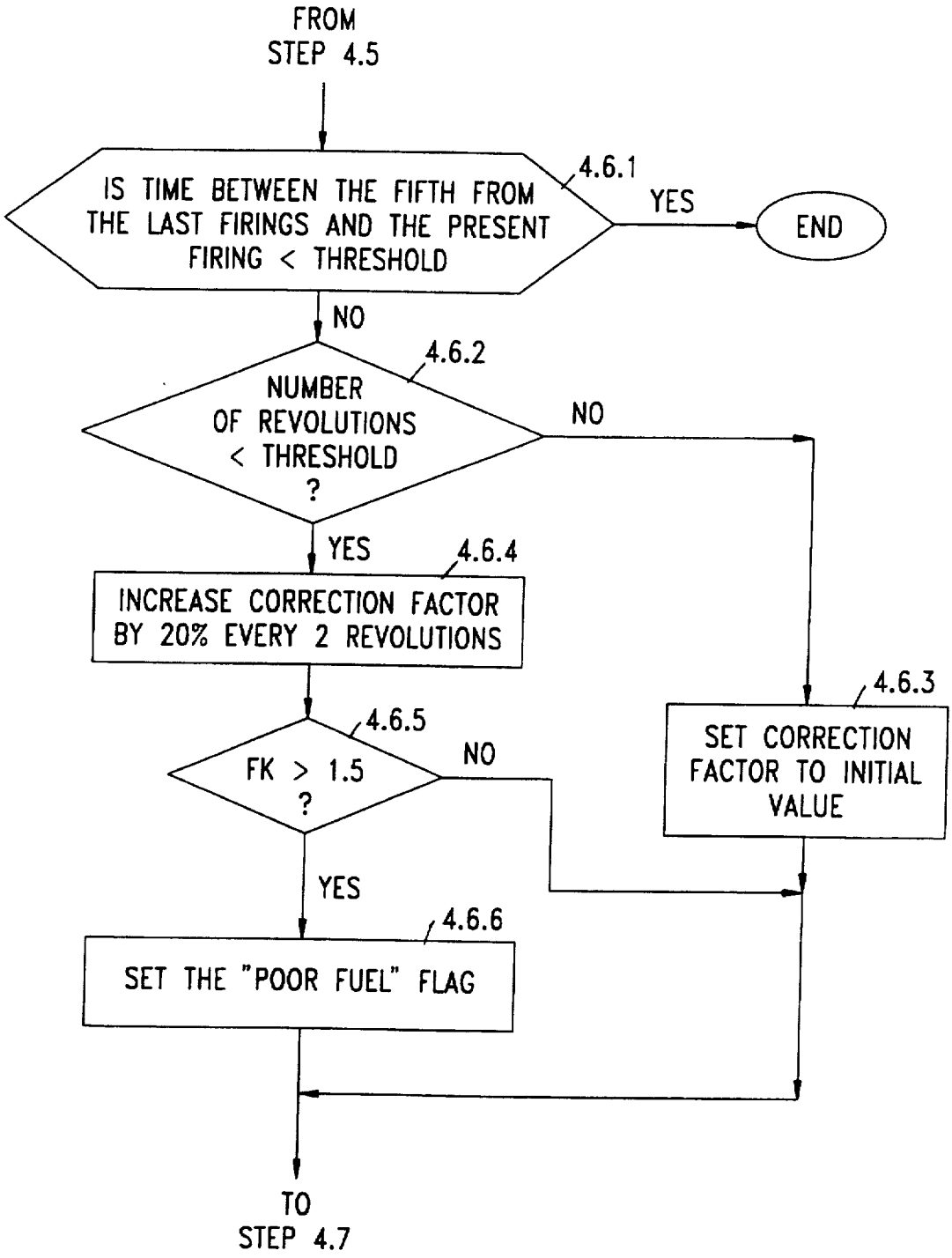
FIG. 5 is a flow chart showing sub-steps included in step 4.6 of FIG. 4.

As shown in FIG. 5, the step 4.6 of FIG. 4 has six substeps 4.6.1 to 4.6.6. In step 4.6.1, the time interval between the fifth from the last firing and the present firing, is checked to determined whether it is below a threshold value. If said time interval is below said threshold, it appears that the mixture fed to the engine has ignited well, at which point the end of the entire procedure of FIG. 4 is reached. Otherwise, operation proceeds to step 4.6.2, in which it is checked whether the number of revolutions is below a threshold value of, for instance, six revolutions. If so, at step 4.6.4, the correction factor FK is increased by 20%, in each case, for every two revolutions. It should be noted here that an increase must not take place with each firing, since a change in the proportioning of the fuel is detected only after a few firings. How many revolutions are awaited and by what percent the correction factor is increased, depend on the specific application.

After the increase of the correction factor, it is checked, at step 4.6.5, whether the correction factor lies above a threshold value, e.g., 1.5, in the case of the exemplary embodiment. If so, a "poor fuel" flag is set in step 4.6.6, which indicates to other fuel-quantity adjustment functions that poor fuel is being used. Such a flag can be dispensed with if no other functions, for instance a restart function or an acceleration enrichment function need be adapted to the fuel used, or if the correction value is so stored that the other functions have direct access to it and can use it unchanged or unmodified. After the setting of the flag, step 4.7 is reached.

If it is determined in step 4.6.2 that the number of revolutions is above the set threshold value, then the correction value is set to its initial value "1", which corresponds to making the air/fuel mixture leaner, as opposed to making it richer, as was the case in step 4.6.4. It is to be noted that step 4.6.3 is reached only if, despite the measures indicated, no increase in the speed of rotation above a threshold value has as yet occurred, which occurrence is checked by the time determination performed in step 4.6.1. However, if due to a lack of combustion the mixture has been continuously made richer, it is to be feared that the engine's combustion chambers, and particularly the spark plugs, are being wetted by liquid fuel. The measure in step 4.6.3 is thus intended to assure drying. In an application in which the engine is not sensitive to such wetting, step 4.6.3 can also be of such a nature that the last correction value set is retained unchanged.

It has been described above that a new correction factor is determined only when poor fuel has been added after good fuel. However, it is also possible to arrive at a correction factor in the reverse direction, i.e., to reduce the correction factor when good fuel is added after poor fuel. For this purpose, it can, for instance, be determined how many combustions have taken place within a predetermined number of firings. The threshold can, for instance, be seven combustions for eight firings. If this threshold is reached, the correction factor is changed toward the value 1.

Whether there has actually been combustion upon a firing can be determined, for instance, by monitoring the change in the speed of rotation from one firing to the next. If there has been a combustion, the speed of rotation increases by a few ten to about 200 rpm as a result. If the function described above is used, the inquiry as to whether gasoline has been added can be dispensed with.

In the above discussion, no temperature dependence of the correction factor was taken into account. In actuality, at an engine temperature of about 30° C., no substantial differences can be noted between good and poor fuel with respect to the engine's cold starting behavior. At such a temperature, therefore, no correction is necessary. However, the differences between good and poor fuel are more perceptible at lower engine temperatures.

In order to take such differences into consideration, one can proceed, for instance, in the manner that a given maximum correction factor is predetermined by a stored characteristic curve for each temperature. If now, for instance, with an engine temperature of 0° C., a correction factor of 1.5 is arrived at, while upon the cold-start there is an engine temperature of +10° C., the corresponding maximum correction factor will be looked up in the characteristic curve. If it is, for instance, 1.3, this value will be used and no further learning will be effected. Instead of a characteristic curve there can also be established merely a pair of a few maximum values for a pair of predetermined temperature ranges.

Another possibility is to store not only one correction factor—to be distinguished from the above-mentioned maximum value for the correction factor—but several correction factors for different temperature ranges. The corresponding correction value is read out in accordance with the existing temperature range. This method can be combined with the method described above of limitation to a maximum correction value.

A third possibility is to store a characteristic curve which indicates in what relationship correction values for different temperatures are to each other. If a correction value is learned and stored, the corresponding engine temperature is stored at the same time. If a new cold start is effected, the corresponding engine temperature is determined and the ratio by which the stored correction value is multiplied is read out from the characteristic curve in order to effect an adaptation to the existing engine temperature.

In connection with the above-described embodiments, it has been assumed that the injection values in the characteristics map 19, are based on the use of a good fuel. If a poorer fuel is then added, the injection times are to be increased, for which mention has been made in all cases of an increase in the correction factor. In the alternative, the values in the characteristics map 19 can be based on the use of a relatively poor fuel instead, especially when such a fuel is more frequently used than a better fuel. In this case, the correction factor would then be reduced when the better fuel is used instead of the poorer fuel.

Instead of a multiplicative correction factor, a summand to be related additively to the injection time, can also be used as a correction value.

What is claimed is:

1. A method of proportioning fuel in an air/fuel mixture to be fed to an internal combustion engine upon a starting of the engine, the method comprising the steps of:

a) sensing a speed of rotation of the engine;

b) determining whether there is an increase in the speed of rotation of the engine within a predetermined range, for as long as a test-end condition has not been satisfied;

c) changing a stored correction value for correcting an amount of fuel injected if it is determined in step b) that the increase in the engine speed of rotation is not within the predetermined range, the correction value being changed as a function of a state of operation of the engine so as to yield an air/fuel mixture which leads, upon combustion, to an increase in the speed of rotation within the predetermined range; and d) controlling a fuel injection device by applying to the fuel injection device a fuel injection control signal derived from a combination of the stored correction value and a fuel injection quantity value.

2. The method according to claim 1, wherein step b) is performed after a predetermined number of firings following the starting of the engine.

3. The method according to claim 2, wherein steps a), b), c) and d) are performed for each of a plurality of progressively increasing numbers of firings, with the predetermined range of speeds of rotation being a function of the plurality of progressively increasing numbers of firings.

4. The method according to claim 1, wherein the correction factor is used for correcting an amount of fuel injected upon a subsequent starting of the engine.

5. The method according to claim 1, further comprising the step of checking, for each firing, whether there is an increase in the speed of rotation, within the predetermined range, between the time of a present firing and the time of a prior firing which precedes the present firing by a predetermined number of firings.

6. The method according to claim 5, further comprising the step of making the air/fuel mixture leaner for a preselected number of rotations of the engine if the mixture has been enriched after repeated carrying out of steps c) and d), thereby drying at least one combustion chamber of the engine.

7. The method according to claim 1, wherein the predetermined range is a range between zero and a predetermined threshold value.

8. The method according to claim 1, wherein the correction value is stored such that other fuel-quantity adjustment functions have access to it.

9. The method according to claim 1, wherein the correction value is limited to a temperature-dependent maximum value.

10. A system for proportioning fuel in an air/fuel mixture to be fed to an internal combustion engine upon a starting of the engine, a speed of rotation of the engine being sensed by a speed sensor, the system comprising:

a controller coupled to the speed sensor, the controller performing the steps of:

testing whether there is an increase in the speed of rotation of the engine within a predetermined range, for as long as a test-end condition has not been satisfied; and changing a stored correction value to correct an amount of fuel injected if the controller determines that the increase in the engine speed of rotation is not within the predetermined range, the controller changing the correction value as a function of a state of operation of the engine so as to yield an air/fuel mixture which leads, upon combustion, to an increase in the speed of rotation within the predetermined range, the controller combining the correction value and a fuel injection quantity value to generate a fuel injection control signal for controlling a fuel injection device.

* * * * *

UNITED STATES PATENT AND TRADEMARK OFFICE

CERTIFICATE OF CORRECTION

PATENT No. : 5,605,138

DATED : February 25, 1997

INVENTOR(S): Hans Deichsel et al.

It is certified that error appears in the above-identified patent and that said Letters Patent is hereby corrected as shown below:

Column 1, line 31, after "has" delete "not";

Column 1, line 66, after"fuel" insert --feed--; (first occurrence)

Column 2, line 66, delete "V-MOT" and insert -- $\hat{U}$-MOT --;

Column 3, line 23, "sped" should be --speed--;

Column 4, line 10, delete "$N_{13}H$" and insert --N_H--; and

Column 4, line 17, delete "$N_{13}L$" and insert --N_L--.

Signed and Sealed this

Twenty-sixth Day of January, 1999

*Attest:*

*Attesting Officer*

*Acting Commissioner of Patents and Trademarks*